US007073282B2

(12) United States Patent
Savagian et al.

(10) Patent No.: US 7,073,282 B2
(45) Date of Patent: Jul. 11, 2006

(54) CLIP-ON WIRE IDENTIFICATION MARKERS

(75) Inventors: Michael D. Savagian, Germantown, WI (US); Steven H. Mess, Franklin, WI (US)

(73) Assignee: Brady Worldwide Inc., Milwaukee, WI (US)

( * ) Notice: Subject to any disclaimer, the term of this patent is extended or adjusted under 35 U.S.C. 154(b) by 0 days.

(21) Appl. No.: 10/802,486

(22) Filed: Mar. 17, 2004

(65) Prior Publication Data

US 2005/0204594 A1 Sep. 22, 2005

(51) Int. Cl.
*G09F 3/00* (2006.01)

(52) U.S. Cl. ..... 40/316; 40/673; 24/129 B; 24/30.5

(58) Field of Classification Search ..... 40/316, 40/637, 334, 673, 672; 24/129 B, 30.5; 20/129 B, 20/30.5

See application file for complete search history.

(56) References Cited

U.S. PATENT DOCUMENTS

| | | | | | |
|---|---|---|---|---|---|
| 1,345,782 | A | * | 7/1920 | Keller | 40/673 |
| 1,563,371 | A | | 12/1925 | Jones | |
| 1,806,162 | A | * | 5/1931 | Hahn | 24/712.6 |
| 2,669,047 | A | * | 2/1954 | Rieger | 40/637 |
| 3,650,059 | A | | 3/1972 | Johnson | 40/316 |
| 3,781,761 | A | * | 12/1973 | Harwood | 439/369 |
| 3,894,731 | A | | 7/1975 | Evans | 269/47 |
| 4,004,362 | A | | 1/1977 | Barbieri | 40/316 |
| 4,267,046 | A | | 5/1981 | Stoev et al. | 210/780 |
| 4,539,767 | A | * | 9/1985 | Jaffe | 40/316 |
| D281,102 | S | * | 10/1985 | Bush et al. | D23/366 |
| 4,639,977 | A | * | 2/1987 | Howard | 24/16 R |
| 4,656,767 | A | | 4/1987 | Tarrant | 40/316 |
| 4,862,617 | A | * | 9/1989 | Cooke et al. | 40/663 |
| 5,092,066 | A | * | 3/1992 | Brewster | 40/617 |
| 5,336,106 | A | * | 8/1994 | Osten | 439/369 |
| 2001/0049896 | A1 | | 12/2001 | Doerr et al. | 40/673 |

FOREIGN PATENT DOCUMENTS

| | | |
|---|---|---|
| DE | 101 14 890 A1 | 10/2002 |
| GB | 2 274 445 | 7/1994 |

* cited by examiner

*Primary Examiner*—Cassandra Davis
(74) *Attorney, Agent, or Firm*—Whyte Hirschboeck Dudek SC

(57) ABSTRACT

An identification marker or tag for wires and other elongated objects is described. In one embodiment, the marker has a generally elongated shape, e.g., an elongated oval, and comprises a surface for bearing indicia and two holes, one hole located near each end of the marker. Each hole is connected to an edge of the marker by a slot or cut that is adapted for ease of clipping the marker onto a wire. The marker is dimensioned in length and width to display text in the font size desired to maximize legibility.

11 Claims, 9 Drawing Sheets

CLIP-ON WIRE IDENTIFICATION MARKERS

FIELD OF THE INVENTION

This invention relates to identification markers. In one aspect, the invention relates to identification markers adapted for attachment to a wire or other elongated object while in another aspect, the invention relates to such markers adapted for clip-on attachment. In still another aspect, the invention relates to a method of producing the markers and the markers in a ribbon assembly for easy distribution, storage, printing and use.

BACKGROUND OF THE INVENTION

Many regulations, common practice and just plain common sense require the clear marking of various elongated objects, e.g., electrical wires and cables, tubes, pipes, and the like. These markers require permanency and legibility, and they require ease of application and permanency of affixation for both new and existing installations.

The most common identification methods for wires and cables are pressure sensitive adhesive (psa) markers that are printed and either wrapped around the object or "flagged". Although these markers often offer good holding or affixation power, they can be difficult to apply. Typically, the marker can be read only from the angle at which it is attached to the wire. If it contains extended text, then this text can be difficult to read because the marker cannot be easily rotated, if rotated at all, about the wire. In addition, the manufacture of a psa marker requires the incorporation of an adhesive coating and a release liner which is eventually discarded.

Another common identification method for wires and other elongated objects is the use of sleeves. These are generally restricted to application to non-terminated wires and the like, i.e., wires and the like with a free end, since they must be slid over the free end of the elongated object. Common methods of application include heat shrinking the sleeve for a snug fit, or applying a pre-flattened sleeve and then relying on the coefficient of friction between the sleeve and the object to hold the sleeve in place. The friction is at the contact point or points between the wire and the distorted pre-flattened sleeve once the sleeve is in place over the wire. U.S. Pat. No. 3,894,731 describes an example of a heat-shrunk sleeve, while U.S. Pat. No. 3,650,059 describes an example of a preflattened, embossed sleeve.

Other marker or tag identification designs exist. These include a single aperture that can slide onto a wire with the legible portion left hanging (U.S. Patent Application, Publication 2001/0049896 A1), the use of multiple apertures through which a wire is threaded (U.S. Pat. No. 1,563,371), a two-hole tag that is held in place by friction and provides a surface for indicia (U.S. Pat. No. 4,539,767), hybrids of a lace-through attachment in combination with a pressure sensitive adhesive (U.S. Pat. No. 4,004,362), and various clasp designs (GB 2274445 A).

The identification of wires and cables and other elongated objects incorporates the basic requirements of legible text and attachment to the object. This identification must withstand the environments to which these elongated objects are exposed while retaining the basic legibility and attachment features. These environments range from temperature extremes, to shock and vibration, to exposure to various solvents. While psa, sleeve and tag markers can withstand these environments when designed for them, they often do so by sacrificing ease of installation or low price, or requiring a compact, close to the wire configuration.

SUMMARY OF THE INVENTION

According to this invention, an identification marker or tag configuration is described that incorporates various features to help resolve the problems of easy attachment, readability of extended text, holding close to the wire, and economic use of materials for use with various terminated and non-terminated elongated objects, particularly wire and cable. The marker of this invention includes a flat surface for bearing indicia that can be applied to the marker by any convenient method, e.g., attachment with an adhesive, printing, etc. The tag can have any shape but is typically of an elongated configuration, e.g., rectangular, oval, etc., and it contains two holes, one hole located near each end of the marker. Each hole is connected to an edge of the marker by a slot or cut that is adapted for ease of clipping the marker onto a wire. The slots for the hole at each end of the tag can be cut from either side of the tag, but preferably the slots are cut from the same side of the marker. Preferably, the slot or cut ends at the inside of the hole (relative to the tag) to offer the best wire retention. The marker is dimensioned in length and width to display text in the font size desired to maximize legibility. The markers of this invention can be easily rotated to allow reading from any angle, and they can be printed on both sides and they remain legible in the environments of their intended use.

DESCRIPTION OF THE PREFERRED EMBODIMENTS

Figure 1:
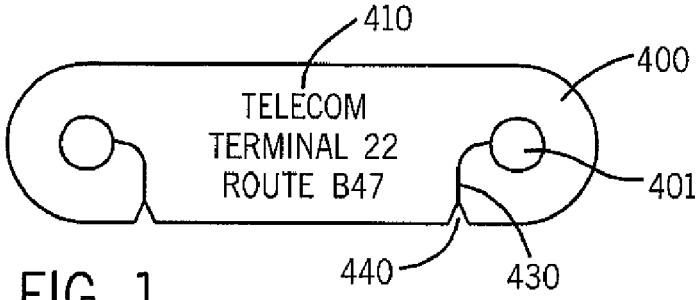
FIG. 1 illustrates one embodiment of a clip-on design.

FIG. 1 illustrates a clip-on marker 400. The marker has a generally elongated oval configuration with holes or apertures 401 near each curved end of the oval. Slots or cuts 430 extend from the interior (relative to the marker) of holes 401 to one straight side or edge of the marker. Optionally, the slots or cuts 430 extend from holes 401 to notches 440. The notches are sized, shaped and cut to easily guide a wire or other elongated object into and through the slots and into the holes. The top surface of the marker bears indicia 410.

Figure 2:
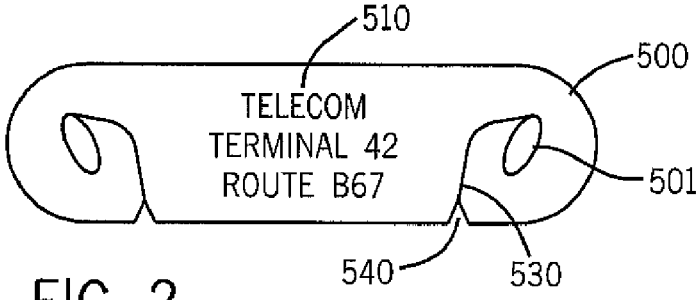
FIG. 2 illustrates another embodiment of a clip-on design.

FIG. 2 illustrates clip-on design 500 which is alike in all ways to design 400 except for the size and shape of the holes and slots. Apertures 501 have an oval configuration, and slots 530 are more extended than slots 430 and terminate at notches 540. In fact, the holes or apertures of the markers of this invention can be shaped and sized as desired to optimize the ease of application and retention power of markers. Marker 500 bears indicia 510 in same the manner marker 400 bears indicia 410.

Figure 3:
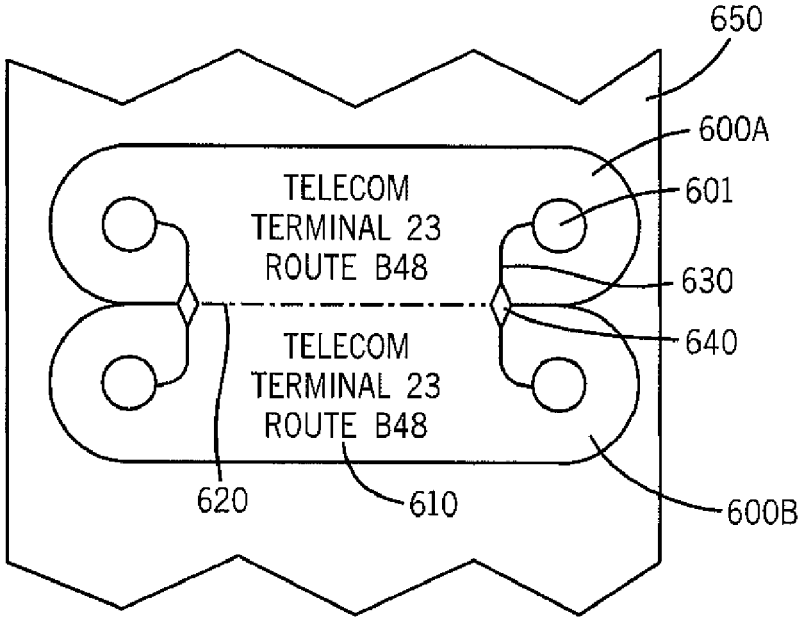
FIG. 3 illustrates one embodiment of a two-sided printable design.

FIG. 3 illustrates a two-sided clip-on marker having sides 600A and 600B. The reverse side of each of sides 600A and 600B carry a pressure sensitive adhesive (not shown). This two-sided clip-on marker is mounted on release liner 650, and carries indicia 610 on sides 600A and 600B. The marker or tag is removed from liner 650, folded along weakness 620 (e.g., a score, perforation, crease, fold line or the like) to secure or affix side 600A to side 600B, and then applied to the elongated object using notches 640, slots 630 and holes 601 in the same manner as described for markers 400 and 500. The notches, slots and holes of sides 600A and 600B are positioned on each such that when the marker is removed from the release liner and folded onto itself, the notches, slots and holes align with one another to allow easy application of the marker to the elongated object. Typically, indicia 610 is printed or otherwise applied to the marker while the marker is still attached to liner 650, but indicia 610 can be applied to the marker by any convenient means, e.g., hand notation, psa-bearing label, etc., after the marker is attached to the elongated object.

Figure 4:
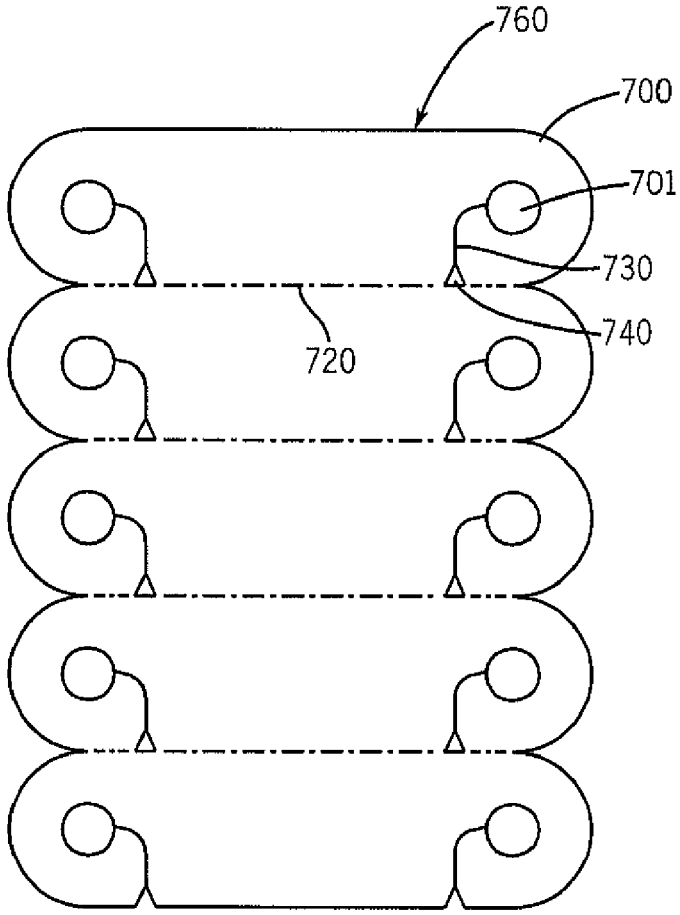
FIG. 4 illustrates a portion of a web of a terminated wire design.

FIG. 4 illustrates a portion of ribbon or web 760 comprising a string of terminated-wire design markers 700. "Non-terminated design" and like terms mean a design for applying an identification marker to a wire or other elongated object that has a free end such as that illustrated in FIGS. 9*a–c* and 10*a–c*. "Terminated wire design" and like terms mean a design for applying an identification marker to a wire or other elongated object that does not have a free end such as that illustrated in FIGS. 6 and 7. Perforations 720 allow each tag to be separated from the tag to which it is attached for eventual application to a wire or other elongated object. Ribbon or web 760 is designed for an easy feed to a label or other printer for applying an indicia (not shown) to each marker. Notches 740, slots 730 and apertures 701 are as illustrated in FIGS. 1 and 3. Markers 700 may be arrayed horizontally, as shown, or longitudinally (not shown). The choice of horizontal or vertical arrangement can easily be made based on the compatibility of the arrangements with a given printer.

Figure 5:
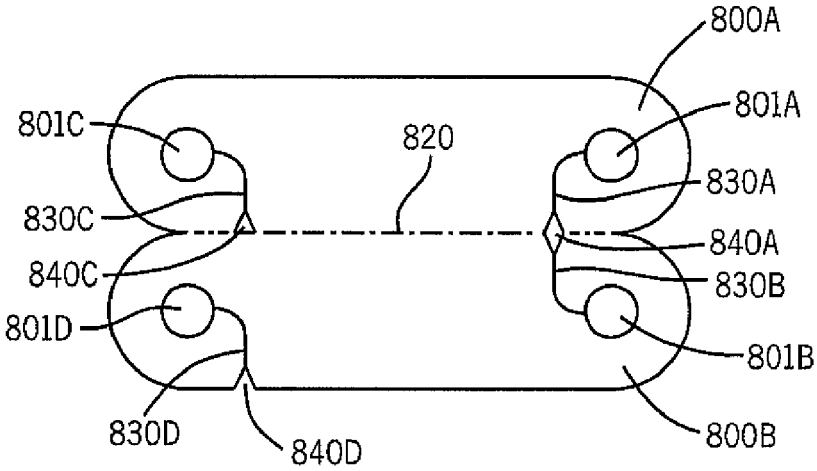
FIG. 5 illustrates a double-sided tag design with a variation of the clip-on feature.

FIG. 5 is a double-sided tag with the variation of an asymmetric clip-on feature. After applying indicia (not shown) to surfaces of sides 800A and 800B, the tag is folded along weakness (e.g., a score line, perforation, crease, fold line, etc.) 820. Symmetrical apertures 801A–D, notches 840A and slots 830A and 830B align when folded as described in the previous double-sided design of FIG. 3. Sides 800A and 800B may be held together by a pressure sensitive adhesive (not shown) and mounted on a liner (not shown), however the marker ends with the asymmetrical slots, i.e., 830C and 830D and optional notches 840C and 840D are not adhesively held together. The wire or other elongated object is inserted first between the asymmetrical slots and the tag is twisted into and through both slots to enable asymmetric gripping. The symmetric side is attached after the asymmetric side is attached. The asymmetric side of the tag provides added security to the holding power of the tag due to the opposing slots.

In an alternative embodiment, both ends of the double-sided tag would have the asymmetric clip-on feature. Preferably, such a dual asymmetric clip-on tag would be used on longer, flexible tags to facilitate the more difficult (compared to a single asymmetric tag) attachment process.

Figure 6:
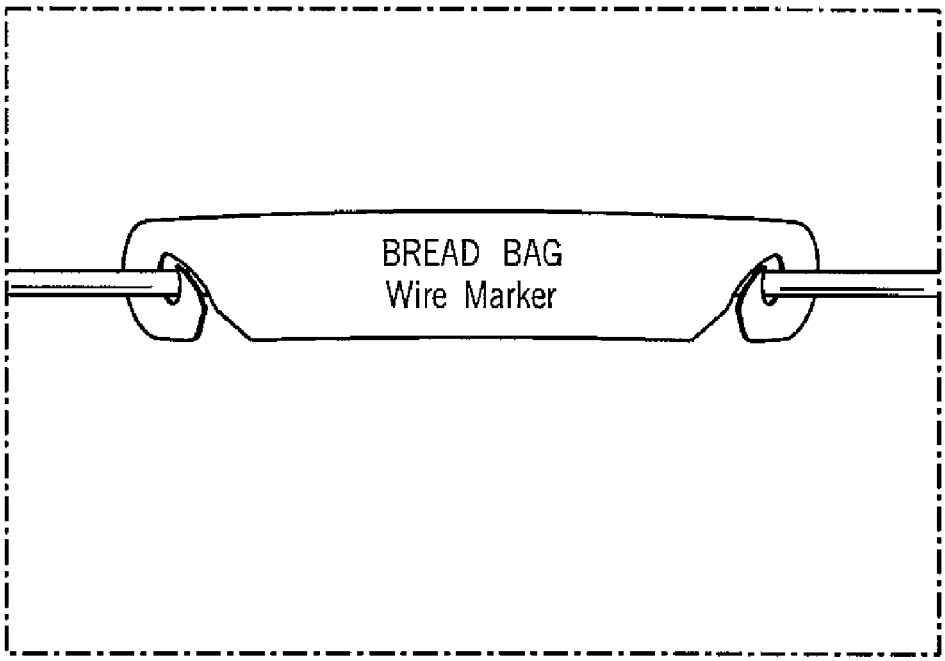
FIG. 6 illustrates a top view of a clip-on design mounted on a wire.
Figure 7:
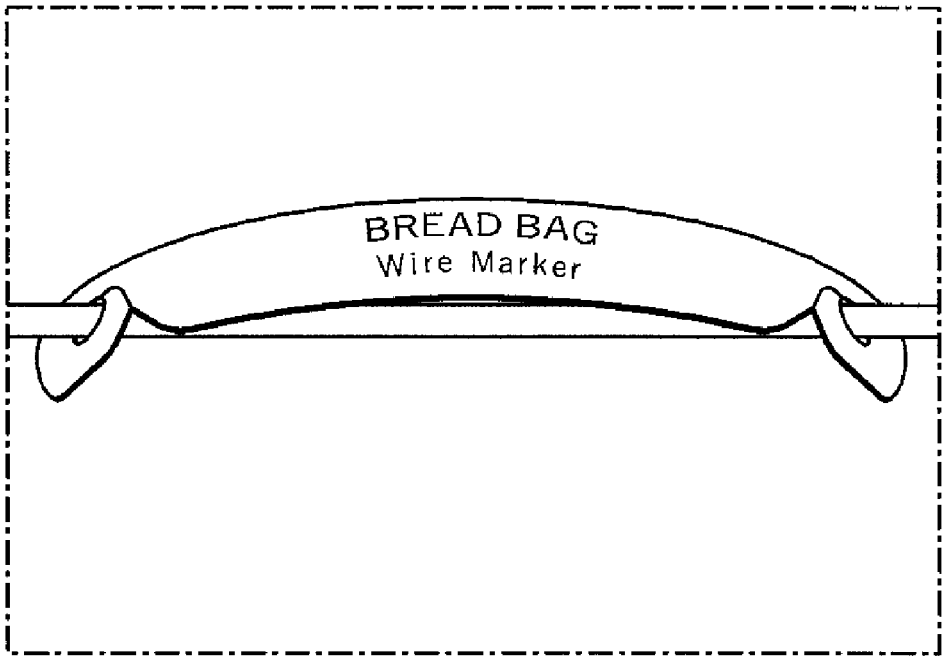
FIG. 7 shows a side view of a clip-on design mounted on a wire.
Figure 8A:
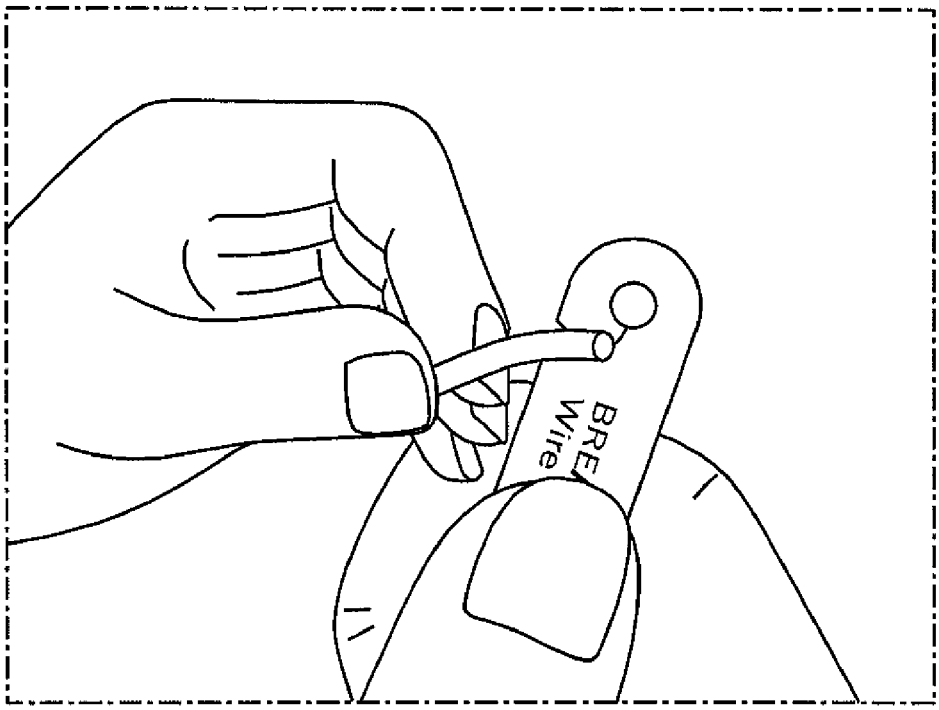
FIGS. 8*a–c* illustrate the sequence of applying the first side of a clip-on design to a wire.
Figure 8B:
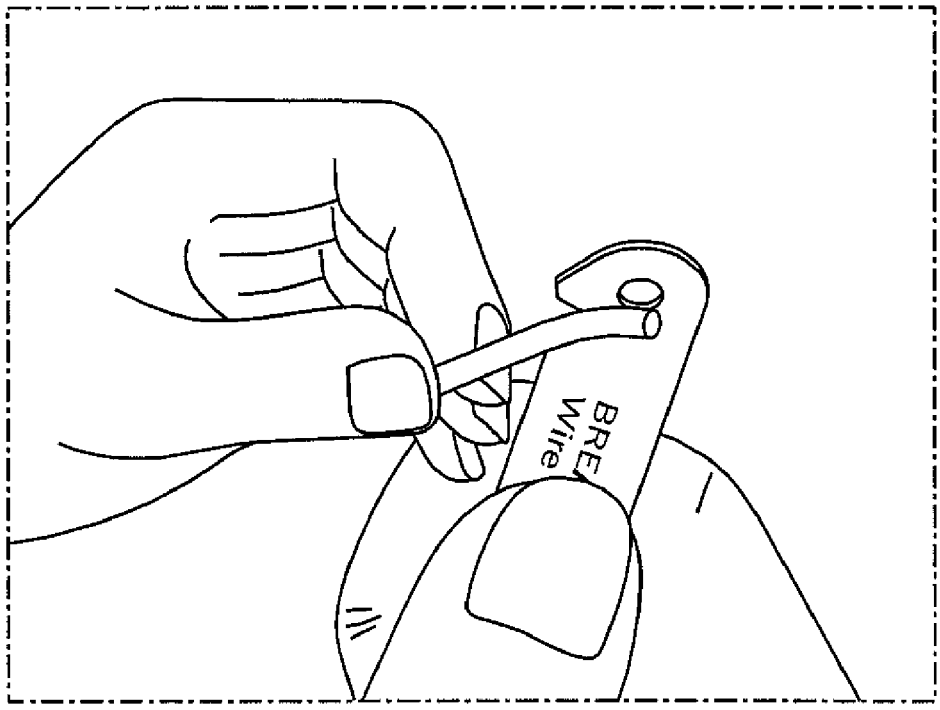
Figure 8C:
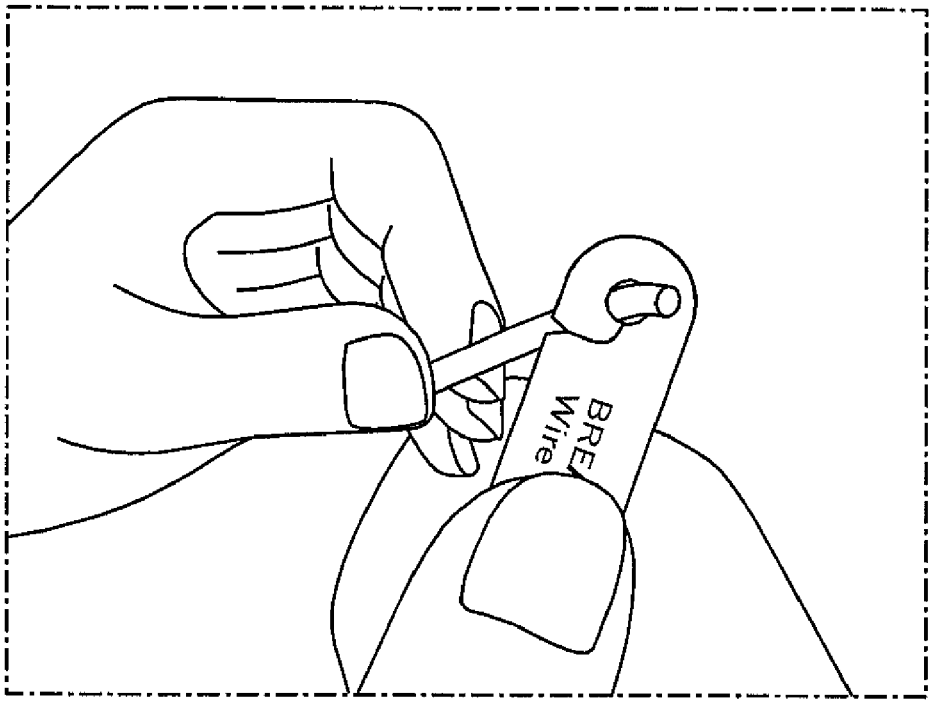
Figure 9A:
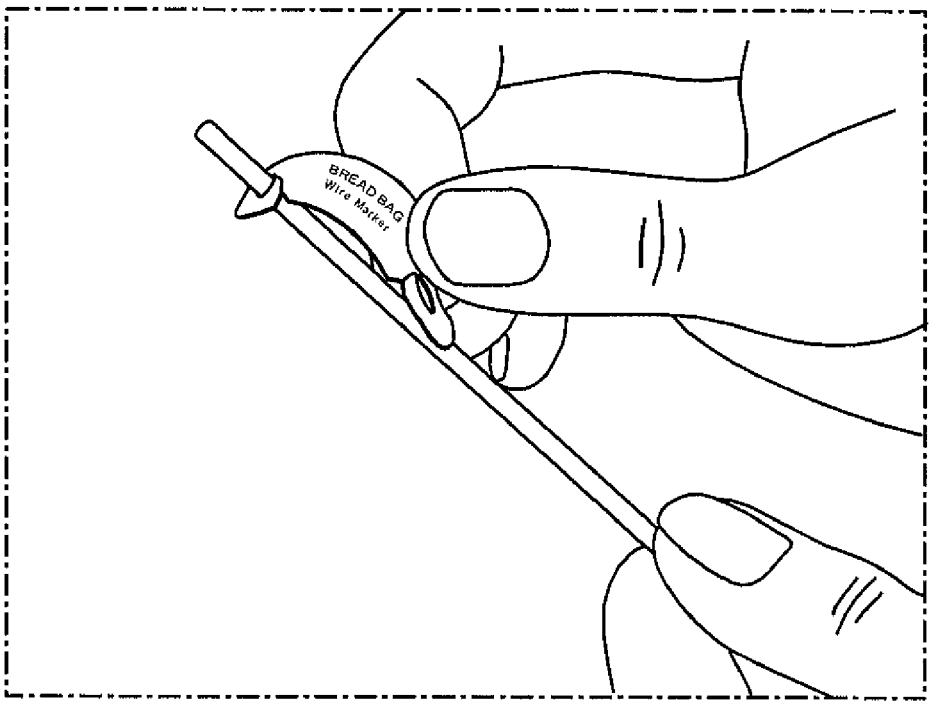
FIGS. 9*a–c* illustrate the sequence of applying the second side of a clip-on design to a wire.
Figure 9B:
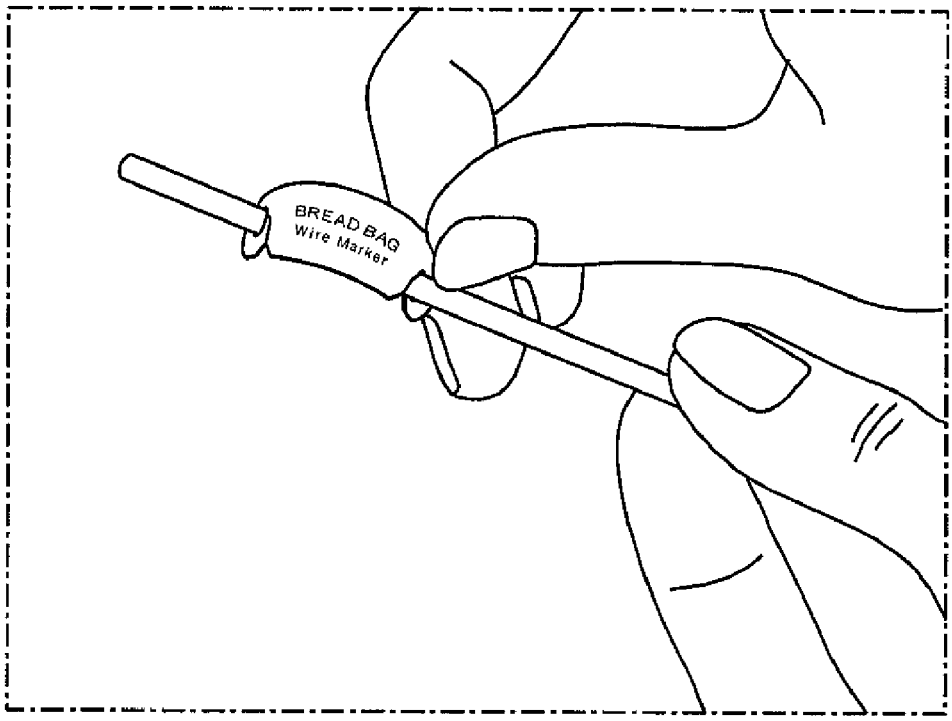
Figure 9C:
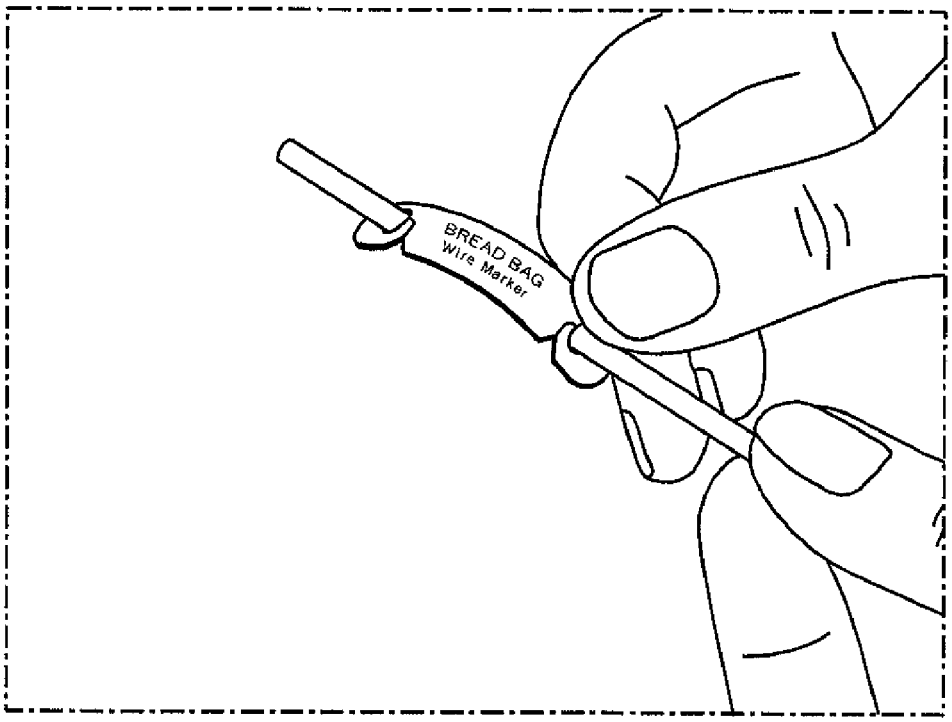
Figure 10A:
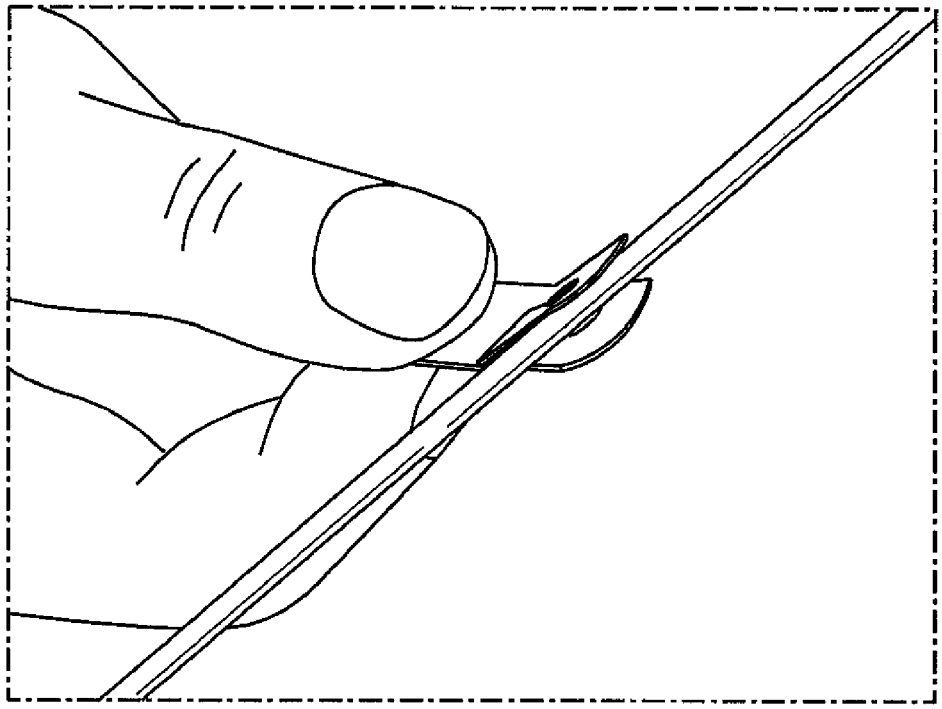
FIGS. 10*a–d* illustrate the sequence of applying the first asymmetrical side of a twist-on design to a wire.
Figure 10B:
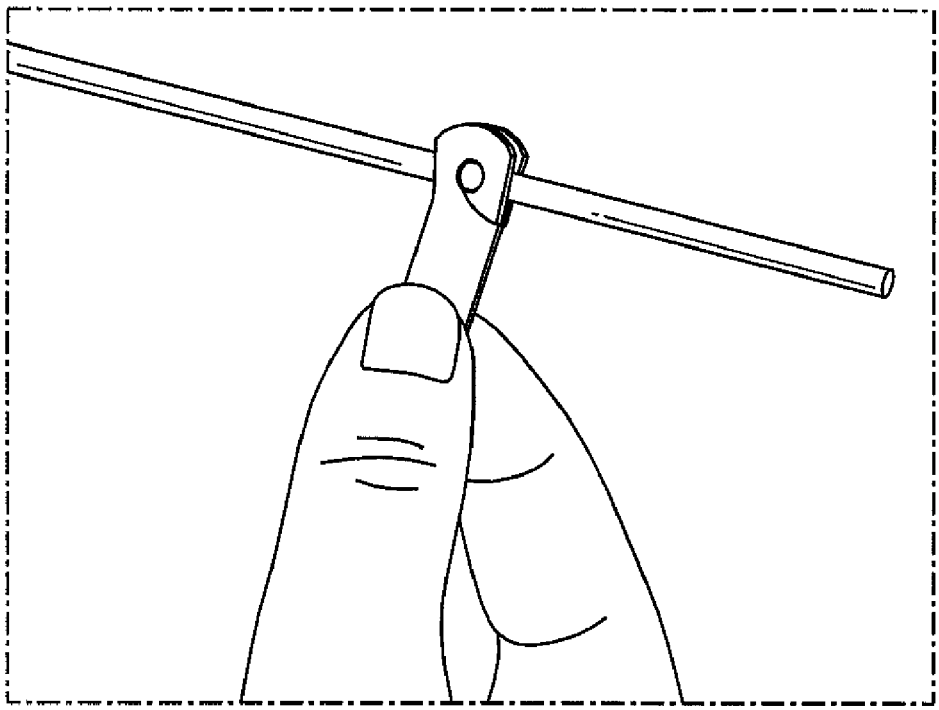
Figure 10C:
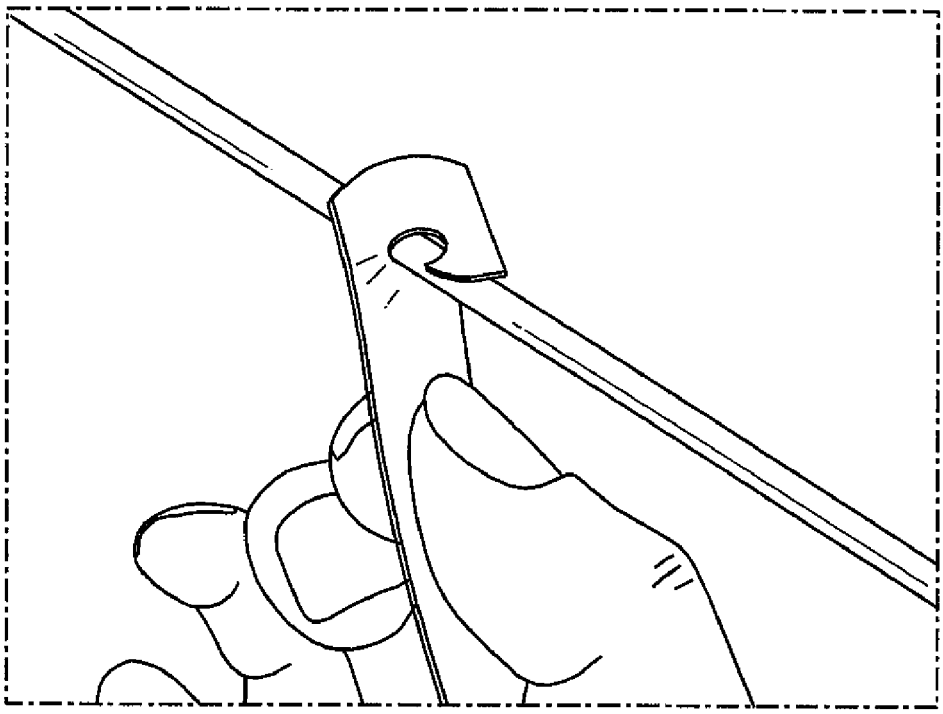
Figure 10D:
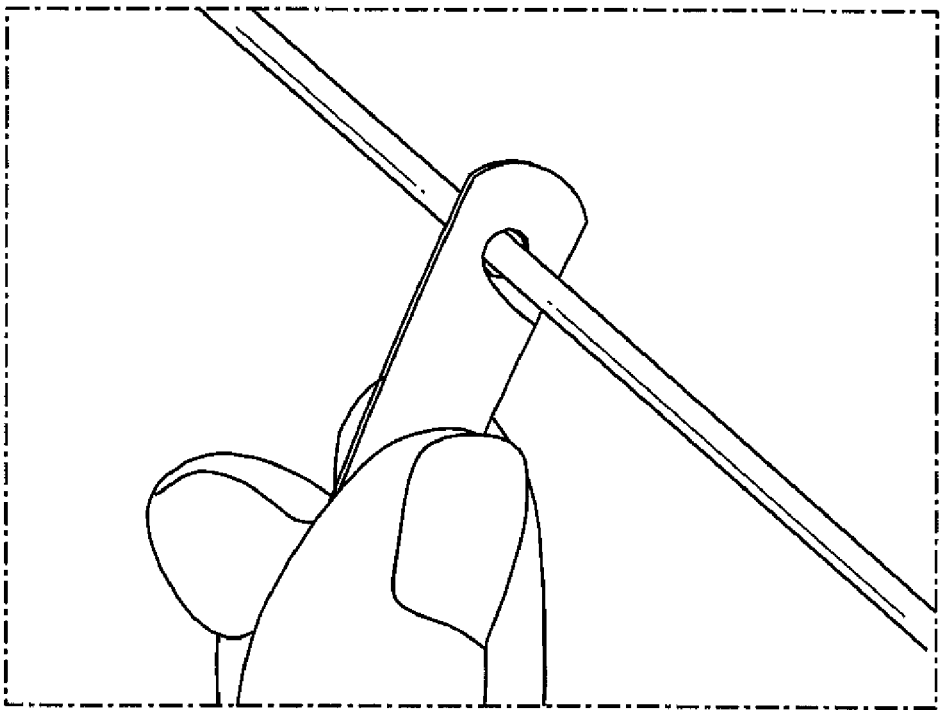

FIGS. 6 and 7 illustrate a tag of FIG. 1 attached to a terminated wire. FIGS. 8*a–c* and 9*a–c* illustrate the attachment of the identification tag to the wire. In FIGS. 8*a–c*, the wire is guided first through one notch, into and through the adjoining slot, and into the adjoining hole. The procedure is then repeated on the wire with the other notch, slot and hole (FIGS. 9*a–c*). The marker is applied to the wire in such a manner that the indicia faces toward a reader, and the marker can easily be rotated about the wire without removal from the wire.

Figure 11A:
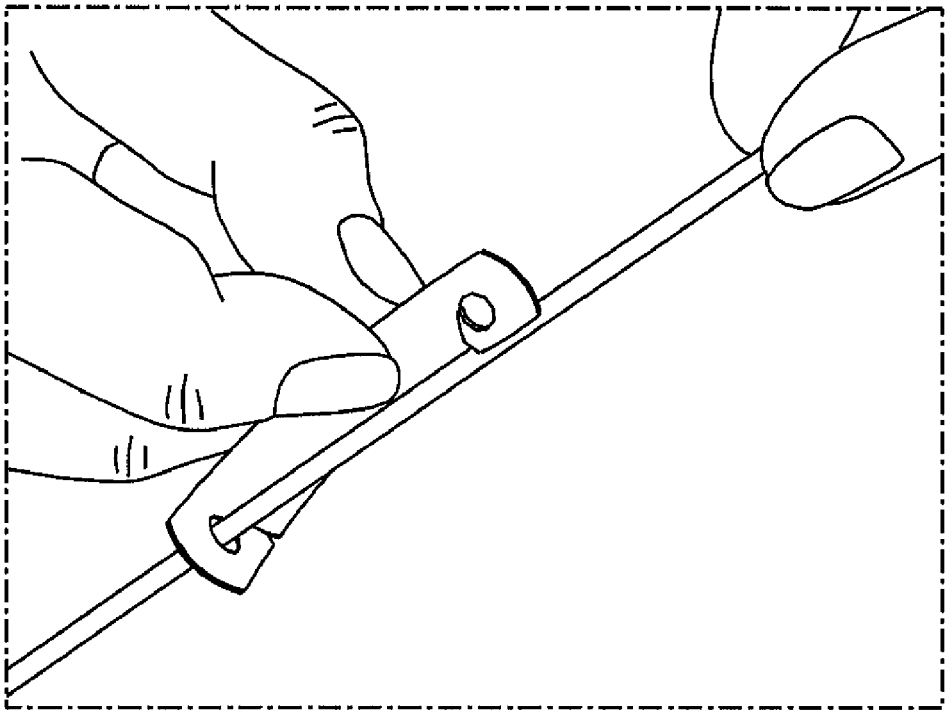
FIGS. 11*a–b* show the sequence of application of the second, symmetrical side of a twist-on design to a wire.
Figure 11B:
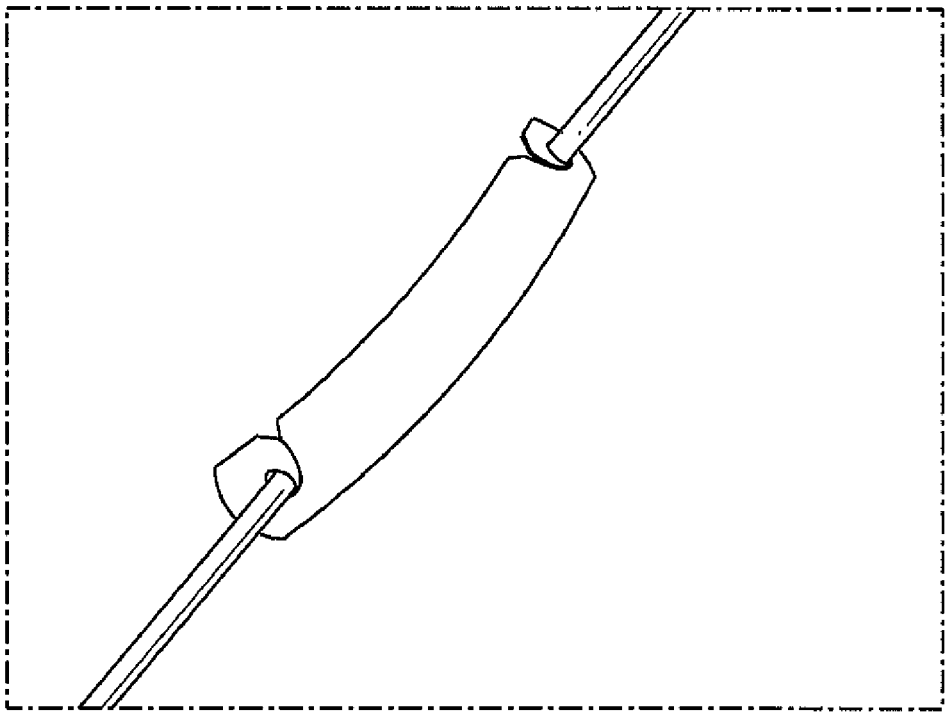

FIGS. 10*a–d* and FIGS. 11*a–b* illustrate the sequence of steps for applying the asymmetrical tag of FIG. 5 to a wire. FIGS. 10*a–d* illustrate the sequence of steps of first applying the asymmetrical side of the tag to the wire, i.e., sliding the wire between the two open sides of the tag and then twisting the tag about the wire so that the wire slides through the slot into the hole of one side and then repeating the procedure with the slot and hole of the other side. FIGS. 11*a–b* illustrate the sequence of steps for then applying the symmetrical side of the tag to the wire.

For ease of installation, non-bent tags, e.g., tags without creases (other than the weakness illustrated for the two-sided tags) such as those illustrated in the Figures, are preferred. These non-bent tags are easily clipped onto a wire or other elongated object, the tag properly sized to the wire or object of course, by holding the tag at as close to a 90 degree angle as possible and clipping the first side. The second side is clipped by simply flexing the tag to a high angle to the wire and clipping it to the wire (as illustrated in FIGS. 8*a–c* and 9*a–c*).

The greater the stiffness of the tag material, the easier the attachment of the tag to the wire or other elongated object (except for tags with dual asymmetric clip-on). In addition, the greater the stiffness, the better the tag will remain affixed to the wire or other elongated object at the point of original attachment. The practical limits of stiffness are set by the requirements of printing and ease of flexing the tag to apply it to a wire or the like. For pre-printed tags, only the ease of installation is important. For unprinted tags that serve as a holder for printed labels, only the ease of installation is important.

The tags used in the practice of this invention are easily manufactured from commonly available materials. The stiffness and toughness of rigid polyvinylchloride, polyester, polycarbonate, PETG, acrylic or other film or sheet material can be employed to make serviceable tags. As film stiffness varies with the cube of its thickness, the correct stiffness material can be selected from each material by selecting the appropriate thickness for any material type. These films are not always printable by any and all methods, and some may require the use of a coating or print treatment of one kind or another. In certain applications, a springy metal can be used if electrical conductivity is not a factor. Useful gauges of the plastic materials range from about 0.005 to about 0.040 inches. Laminates of various materials can also serve as useful tags provided they provide the desirable stiffness, printability, coefficient of friction, handability and environmental resistance for a given application. Reinforcement of the clip-on ends of the tags is another embodiment of the tags of this invention. In this embodiment, the center of the tag remains more flexible.

While the tags of this invention can be manufactured in single form, typically and preferably they are manufactured in ribbon, web, or continuous roll form. This is easily accomplished by acquiring a roll of desired material, and then slitting to width, punching the appropriate holes, and die cutting the slots, edges and perforations as desired. This technique produces little waste. The roll can be printed or printed on demand in a bench top or portable printer. Thermal transfer printing can give excellent legibility and permanence while being fast and economical. Certain printers may require registration marks if the punches and cutting incorporated into the roll are not sufficient for this purpose. In this instance, an additional section of material can be included along an edge of the continuous roll that has these registration marks or punches.

The double-sided embodiment of these tags is also printable if the tags can also be made from a thinner, more flexible material than that used for a single-side embodiment tag. The psa is, of course, covered with a liner until the tag is ready for application to the wire or other elongated object. The tag is actually cut in duplicate with a folding line or perforation. In this case, the printing for each side can be done in one pass through a printer and at the time the tag is to be placed into use. The tags are removed from the liner and folded upon themselves to gain the desired stiffness. Any special registration marks or punches required for the printing can be included on the carrier liner rather than the tag material itself. Each tag can be individually cut rather than perforated.

Although the invention has been described in considerable detail through the specification and figures, one skilled in the art can make many variations and modifications without departing from the spirit and scope of the invention as described in the following claims. All U.S. patents and allowed U.S. patent applications cited above are incorporated herein by reference.

What is claimed is:

1. A double-sided identification marker for attachment to an elongated object, the marker comprising a flat, flexible material and having first and second components, each component a mirror image of the other and each component having a first and second side with the first side of at least one component adapted for bearing indicia and the second side of at least one component bearing an adhesive with bonding power, the second side of each component joined to the other through the bonding power of the adhesive, the marker further comprising (i) edges, (ii) first and second ends with a hole located near each end, and (iii) a slot extending from each hole to an edge.

2. The marker of claim 1 in which the slots terminate in a notch cut into the edge of the component.

3. The marker of claim 1 in which the slots align with one another when the components of the marker are joined to one another.

4. The marker of claim 1 in which the slots near one end of the marker do not align with one another when the components of the marker are joined to one another.

5. The marker of claim 4 in which the adhesive does not extend to the end of the marker in which the slots do not align with one another.

6. The marker of claim 4 attached to an elongated object.

7. The marker of claim 6 in which the elongated object is selected from the group consisting of a wire, cable, conduit, tube and pipe.

8. A ribbon comprising a plurality of the markers of claim 4.

9. A ribbon comprising a plurality of the markers of claim 1.

10. The marker of claim 1 attached to an elongated object.

11. The marker of claim 10 in which the elongated object is selected from the group consisting of a wire, cable, conduit, tube and pipe.

* * * * *

UNITED STATES PATENT AND TRADEMARK OFFICE

CERTIFICATE OF CORRECTION

PATENT NO. : 7,073,282 B2
APPLICATION NO. : 10/802486
DATED : July 11, 2006
INVENTOR(S) : Michael D. Savagian and Steven H. Mess It is certified that error appears in the above-identified patent and that said Letters Patent is hereby corrected as shown below:

Column 3, line 30: Insert the word --wire-- after ""Non-terminated".

Signed and Sealed this

Twelfth Day of September, 2006

JON W. DUDAS
*Director of the United States Patent and Trademark Office*